US006022190A

United States Patent [19]

Schillinger

[11] Patent Number: 6,022,190

[45] Date of Patent: Feb. 8, 2000

[54] TURBINE IMPELLER DISK WITH COOLING AIR CHANNELS

[75] Inventor: Thomas Schillinger, Minzeweg, Germany

[73] Assignee: BMW Rolls-Royce GmbH, Oberursel, Germany

[21] Appl. No.: 09/019,812

[22] Filed: Feb. 6, 1998

[30] Foreign Application Priority Data

Feb. 13, 1997 [DE] Germany ..... 197 05 442

[51] Int. Cl.[7] ..... F01D 5/08

[52] U.S. Cl. ..... 416/96 R; 416/95; 416/97 A; 416/220 R; 415/115

[58] Field of Search ..... 416/95, 96 R, 416/97 A, 97 R, 220 R; 415/115, 116

[56] References Cited

U.S. PATENT DOCUMENTS

| | | | |
|---|---|---|---|
| 3,849,025 | 11/1974 | Grondahl | 416/97 R |
| 4,275,990 | 6/1981 | Langley et al. | 416/95 |
| 4,344,738 | 8/1982 | Kelly et al. | 416/95 |
| 4,522,562 | 6/1985 | Glowacki . | |
| 4,626,169 | 12/1986 | Hsing et al. | 416/95 |
| 5,244,345 | 9/1993 | Curtis | 416/95 |
| 5,318,404 | 6/1994 | Carreno et al. | 416/96 R |
| 5,593,274 | 1/1997 | Carreno et al. | 415/115 |
| 5,755,556 | 5/1998 | Hultgren et al. | 416/96 R |
| 5,795,130 | 8/1998 | Suenaga et al. | 416/95 |
| 5,800,124 | 9/1998 | Zelesky | 416/95 |
| 5,816,777 | 10/1998 | Hall | 416/97 R |

FOREIGN PATENT DOCUMENTS

| | | |
|---|---|---|
| 2947521 | 6/1986 | Germany . |
| 4428207 | 2/1996 | Germany . |
| 2065788 | 7/1981 | United Kingdom . |

*Primary Examiner*—Edward K. Look
*Assistant Examiner*—Matthew T. Shanley
*Attorney, Agent, or Firm*—Pillsbury Madison & Sutro LLP

[57] ABSTRACT

In connection with a turbine rotor disk in whose disk grooves air-cooled turbine blades have been inserted, at least two cooling air channels, respectively extending from the same disk front face, terminate in each disk groove. The outlet openings of two cooling air channels in each disk groove preferably lie essentially next to each other in a common sectional plane, which is normal to the disk axis. Because of this it is possible to supply a larger cooling air flow without drastically increasing the weakening, or respectively the stress of the disk in the groove bottom.

7 Claims, 2 Drawing Sheets

TURBINE IMPELLER DISK WITH COOLING AIR CHANNELS

FIELD OF THE INVENTION

The invention relates to a turbine impeller disk with cooling air channels extending from the disk front face and terminating in the disk grooves, into which air-cooled turbine blades have been inserted.

BACKGROUND OF THE INVENTION

In connection with the technical background, reference is made, for example to German Patent Publications DE 29 47 521 A1 and DE 34 44 586 A1.

In connection with the employment of air-cooled turbine blades, in particular in gas turbines, the cooling air supply via channels in the rotating disks which terminate in the disk grooves, has basically proven itself. In this manner it is also possible to supply cooling air to a second turbine disk arranged behind a first disk, in that a portion of the air flow reaching the disk grooves of the first disk is moved via these disk grooves toward the back, so to speak, into the space between the first and second co-rotating disk. To this end it is possible to provide appropriate passages in the so-called retainer plates, which axially secure the blades inserted into the disk grooves.

The conveyance of a sufficiently large cooling air flow into the respective disk groove can be problematical, in particular if a portion of this cooling air flow is also intended for cooling a downstream turbine disk. It is not possible to design the cross-section a of a cooling air channel terminating in the groove bottom of the disk groove to have any arbitrary size, since in this outlet area individual stress concentrations of the peripheral stress are superimposed on each other and can cause locally greatly increased stress levels, which is undesirable.

OBJECT AND SUMMARY OF THE INVENTION

It is the object of the instant invention to disclose a remedial measure for the above mentioned problems.

This object is attained in that at least two cooling air channels, which respectively extend from the same disk front face, terminate in every disk groove.

Advantageous embodiments and further developments are the is subject of the dependent claims.

Reference is made to the attached basic diagrams for a more detailed explanation of the invention, and for explaining the physical correlations.

DETAILED DESCRIPTION OF THE PREFERRED EMBODIMENT

Figure 1:
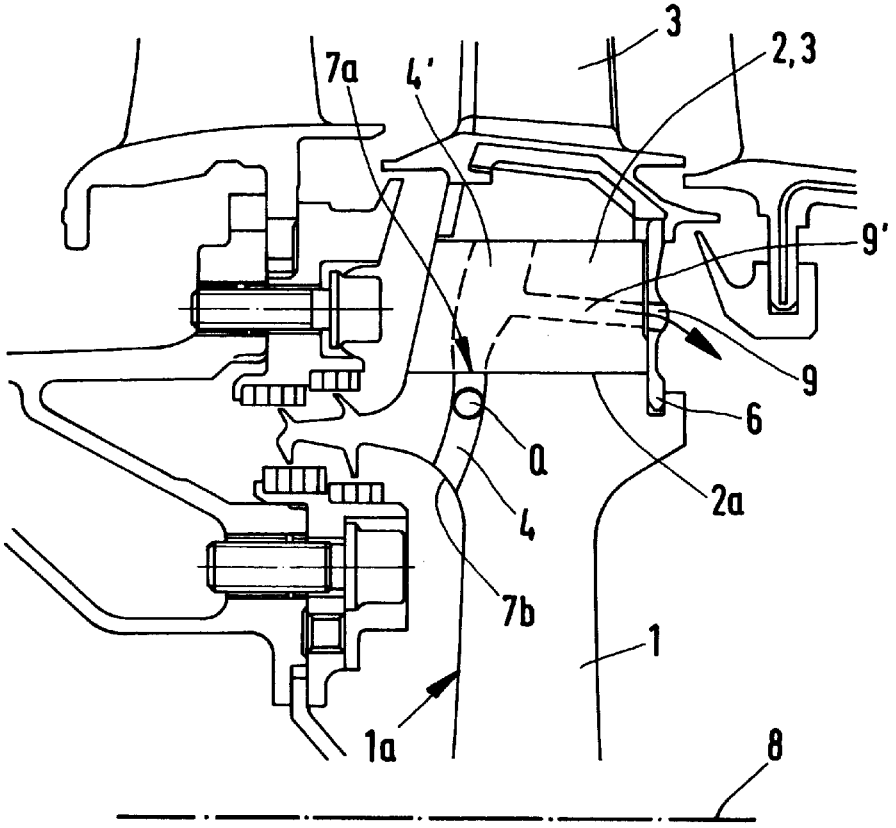
FIG. 1 represents a partial longitudinal section of a preferred embodiment of a turbine rotor disk in accordance with the invention.
Figure 2:
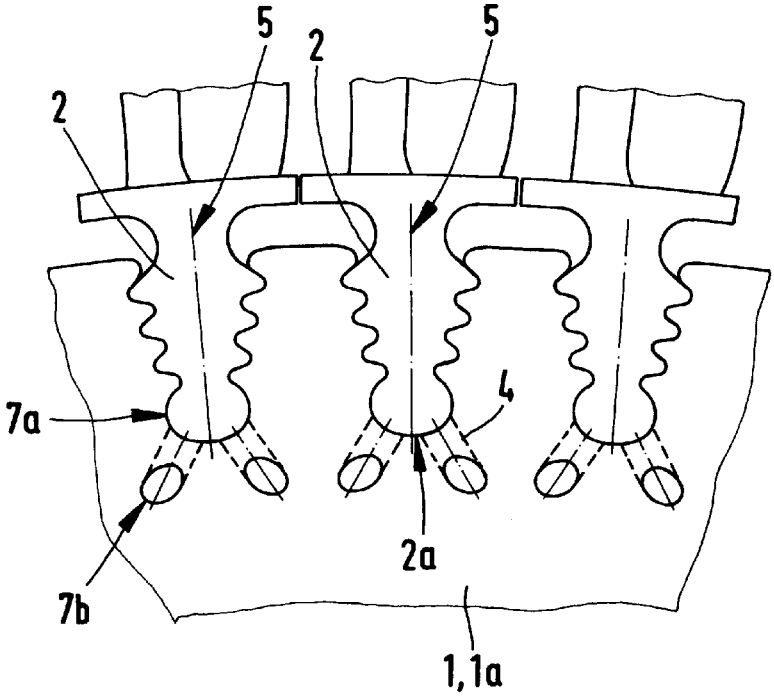
FIG. 2 represents a partial plan view of the preferred embodiment in accordance with FIG. 1.

A disk, in particular of a gas turbine, is identified by the reference numeral 1 in FIGS. 1 and 2, which has a multitude of disk grooves 2, each having a Fir tree profile, on its outer circumference in the customary manner, into each of which a turbine blade 3 has been inserted. Each turbine blade 3 is air-cooled, i.e. cooling air channels, not represented, are provided in each turbine blade 3, into which a cooling air flow can enter from the direction of the disk groove 2.

This cooling air flows enters into each disk groove 2 via at least two cooling air channels 4, which extend from the disk front face 1*a*—the appropriate outlet opening is identified by the reference numeral 7*b*—and are conducted in the interior of the disk to the respective disk groove 2, where they terminate in the groove bottom 2*a* (outlet opening 7*a*). It is obvious that it is possible to supply a cooling air flow of a larger size by means of at least two cooling air channels 4, which extend from the same disk front face 1*a* and which respectively have a defined cross-sectional surface Q, than by means of a single cooling air channel 4 of the same cross-sectional surface Q, such as is known and customary in connection with the prior art. Although it would be basically possible to provide a single cooling air channel 4 with a correspondingly larger cross-sectional surface (for example 2×Q), the correspondingly larger outlet opening 7*a* of a cooling air channel of such size would cause considerable stress peaks in the groove bottom 2*a*, which are greater than the stress peaks caused by the outlet openings 7*a* of two correspondingly smaller cooling air channels 4.

Figure 3:
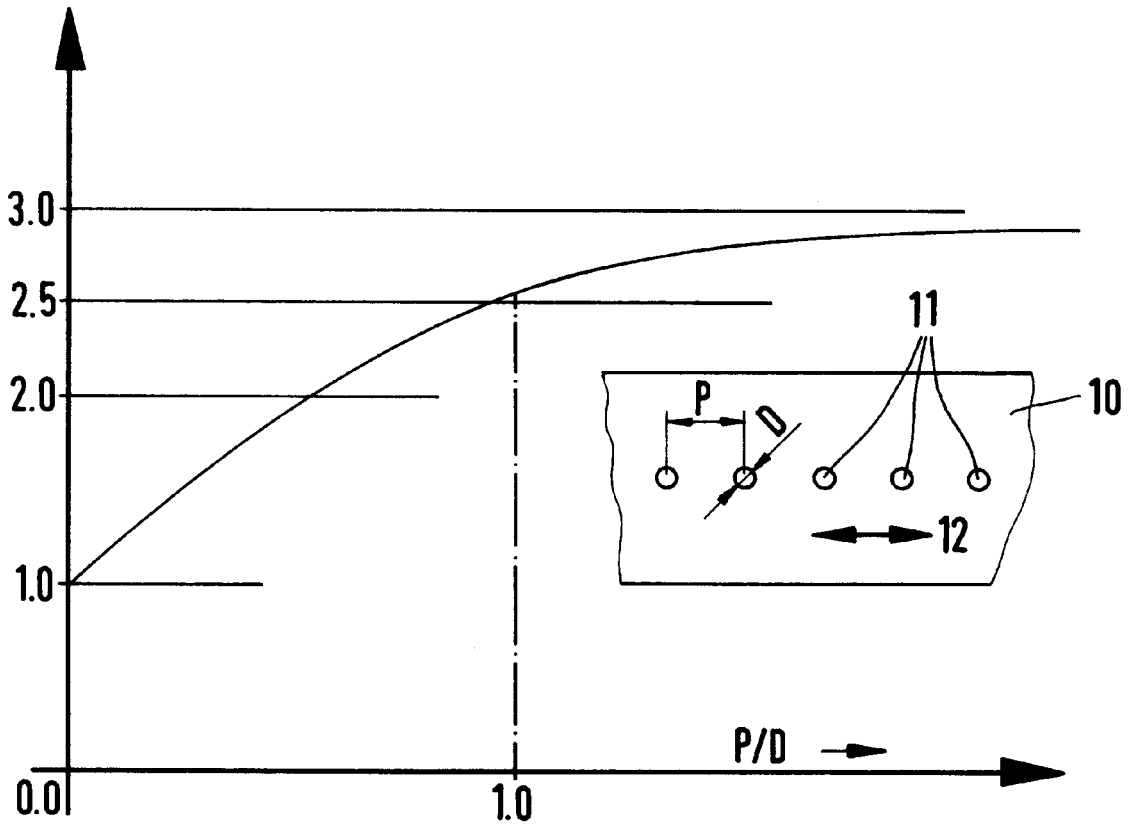
FIG. 3 is a diagram of the stress concentration.

The respective theoretical physical correlations will be briefly explained by means of FIG. 3, in which the stress concentration (plotted on the ordinate) of a diagram is shown as the function of the dimensionless ratio P/D, plotted on the abscissa, in connection with a linear arrangement of holes with the diameter D, which are spaced apart by the amount or distance P.

First, a top view of a component 10 is shown, in which a row of holes 11, each with a diameter D, has been provided. In this case the individual holes 11 are spaced apart from each other by the amount P. The main stress direction along the row of holes 11 is represented by the arrow 12. In the diagram of FIG. 3, the stress concentration factor has been plotted on the ordinate, and the dimensionless ratio of distances P/D on the abscissa.

It can be seen that with a decreasing dimensionless hole ratio of distances P/D the stress concentration factor also becomes less.

By means of the division in accordance with the invention of the cross-sectional surface Q into twice the number of bores 7*a* in FIGS. 1 and 2, the parameter P/D in accordance with FIG. 3 is reduced to 0.707 times its original value, so that because of this the stress concentration factor is reduced correspondingly.

In addition, it is possible to make use of the spatial displacement of the stress peaks, since the locations of the relative stress maxima of the air holes and the disk grooves now no longer coincide in the circumferential direction.

In this way, it is possible to reduce the absolute peak stress, resulting from the (according to theory) superpositioning of the individual stress fields around the bore and grooves, to a considerable extent. This is something to be striven for in view of the importance of improving the fatigue strength of a turbine disk.

Returning to the structural design of the invention, a cooling channel arrangement results which, regarding the size of the cooling air flow which can be achieved, as well as in view of the weakening of the turbine disk 1 by the cooling air channels 4, is advantageous, if in each disk groove 2 the outlet openings 7*a* of the two cooling air channels 4 lie next to each other essentially in a common section plane, which is normal in respect to the disk axis. In this case it is advantageous if—as shown in the partial view of the disk front face la in FIG. 2—in each disk groove 2 the two cooling air channels are provided essentially laterally diverging, as well as inclined, in respect to a plane of symmetry 5 leading in the radial direction from the disk axis, not represented, to the center of the disk groove 2. In this case the cross section normal to the longitudinal axes of all cooling air channels 4 can be shaped arbitrarily circular or elliptical or in any other suitable way. Also the said channels may feature straight longitudinal axes or develop around a curved spine.

As already mentioned at the outset, a portion of the cooling air flow introduced into the disk grooves 2 of this turbine disk can be used for supplying cooling air to a second turbine disk (not represented), connected behind the first disk 1. It is possible to provide, in the area of the disk grooves 2, appropriate passages 9 for a partial cooling air flow in the retaining plates 6 fixing the turbine blades 3 in place in the rotating disk 1, which are respectively connected via a channel 9' provided in the base of the turbine blade with a cooling air channel 4' provided in the blade base and joining the cooling air channel 4.

In general, by means of the doubling, or respectively multiplying the cooling air channels 4 terminating in a disk groove 2, it is possible to provide a clearly larger cooling air flow to the base of each turbine blade 3, compared with the known prior art. In this case the increased number of outlet openings 7*a* of the increased number of cooling air channels 4 clearly results in smaller geometrically caused stress concentration factors on the rotating disk 1 than would be caused by a single cooling air channel with a correspondingly increased cross-sectional surface and a therefore correspondingly increased outlet opening 7*a*. A multitude of variants, in particular of a structural type, from the exemplary embodiment represented are of course possible without departing from the contents of the claims.

What is claimed is:

1. A turbine rotor disk having front and rear faces and blade fixing grooves into which air-cooled turbine blades are insertable, including:

at least two cooling air channels for each disk groove respectively extending from the disk front face and terminating in the disk groove, each cooling air channel having a separate inlet opening on the disk front face, the cooling air channel inlets for each disk groove positioned next to each other on the disk front face, the cooling air channels for each disk groove having outlet openings positioned next to each other in the disk groove in substantially a common sectional plane which is normal to the disk axis.

2. The turbine rotor disk in accordance with claim 1, wherein for each disk groove, two cooling channels are provided, with the channels extending from the groove in a diverging manner and being inclined, with respect to a plane of symmetry extending in a radial direction from the disk axis to a center of the corresponding disk groove section.

3. The turbine rotor disk in accordance with claim 1, wherein a passage is provided through the disk to allow a portion of the cooling air flow conveyed through at least one of the cooling air channels terminating in each disk groove to be passed to a second turbine rotor disk connected adjacent the turbine rotor disk.

4. The turbine rotor disk in accordance with claim 3, wherein a passage is provided through the disk for each cooling air channel to allow a portion of the cooling air flow conveyed through each of the cooling air channels terminating in each disk groove to be passed to the second turbine rotor disk.

5. A turbine rotor disk having front and rear faces and blade fixing grooves into which air-cooled turbine blades are insertable, including:

two cooling air channels for each disk groove respectively extending from the disk front face and terminating in each disk groove, with the channels for each disk groove extending from the groove in a diverging manner and being inclined, with respect to a plane of symmetry extending in a radial direction from the disk axis to a center of the corresponding disk groove section.

6. The turbine rotor disk in accordance with claim 5, wherein a passage is provided through the disk to allow a portion of the cooling air flow conveyed through at least one of the cooling air channels terminating in each disk groove to be passed to a second turbine rotor disk connected adjacent the turbine rotor disk.

7. The turbine rotor disk in accordance with claim 6, wherein a passage is provided through the disk for each cooling air channel to allow a portion of the cooling air flow conveyed through each of the cooling air channels terminating in each disk groove to be passed to the second turbine rotor disk.

* * * * *